US007806563B1

(12) United States Patent
Bruck et al.

(10) Patent No.: US 7,806,563 B1
(45) Date of Patent: Oct. 5, 2010

(54) LED COOLER APPARATUS AND METHOD OF USE

(75) Inventors: Michael Raymond Bruck, Morrilton, AR (US); Patrick Stuart Mullins, Russellville, AR (US)

(73) Assignee: Intencity Lighting, Inc, Dardanelle, AR (US)

( * ) Notice: Subject to any disclaimer, the term of this patent is extended or adjusted under 35 U.S.C. 154(b) by 485 days.

(21) Appl. No.: 11/893,754

(22) Filed: Aug. 17, 2007

Related U.S. Application Data

(60) Provisional application No. 60/838,743, filed on Aug. 17, 2006.

(51) Int. Cl.
*F21V 29/00* (2006.01)

(52) U.S. Cl. ..... 362/294; 362/373; 362/240; 362/249.03; 362/800

(58) Field of Classification Search ..... 362/294, 362/373, 345, 800, 240, 249.13
See application file for complete search history.

(56) References Cited

U.S. PATENT DOCUMENTS 4,729,076 A * 3/1988 Masami et al. ..... 362/235
5,782,555 A 7/1998 Hochstein
6,450,662 B1 9/2002 Hutchinson
6,527,422 B1 3/2003 Hutchinson
6,614,358 B1 9/2003 Hutchinson
6,910,794 B2 * 6/2005 Rice ..... 362/547
2005/0265035 A1 * 12/2005 Brass et al. ..... 362/451

* cited by examiner

*Primary Examiner*—Sandra L O'Shea
*Assistant Examiner*—Jessica L McMillan
(74) *Attorney, Agent, or Firm*—Mind Law Firm; Justin G. Sanders; Jeromye V. Sartain

(57) ABSTRACT

A convection cooling system for high-output Light Emitting Diodes in outdoor illumination applications. The cooling system takes advantage of wide-angle LED output so as to allow placement of cooling fins directly on the shaded underside of the molded or extruded support structure. Accordingly, the cooling system provides a relatively large convective surface area with a substantial portion of that surface shaded from solar radiation so as not to collect solar heat during daytime periods while still expelling heat as it is collected from finned portions that are exposed to sunlight and so do collect solar heat.

14 Claims, 2 Drawing Sheets

*Preferred Embodiment*

LEDs are exposed to solar heat MINUS the heat expelled from fins

*Simplified Thermal Circuit Diagram*

*Preferred Embodiment*

*Simplified Thermal Circuit Diagram*
*Preferred Embodiment*

LED COOLER APPARATUS AND METHOD OF USE

RELATED APPLICATIONS

This application claims priority and is entitled to the filing date of U.S. Provisional Application Ser. No. 60/838,743 filed Aug. 17, 2006, and entitled "LED COOLER FOR OUTDOOR ILLUMINATION APPLICATIONS". The contents of the aforementioned application are incorporated by reference herein.

INCORPORATION BY REFERENCE

Applicants hereby incorporate herein by reference any and all U.S. patents and U.S. patent applications cited or referred to in this application.

BACKGROUND OF THE INVENTION

1. Field of the Invention

Aspects of this invention relate generally to cooling of Light Emitting Diodes (LEDs) when powered under electrical bias, and also to cooling the LEDs while outdoors in direct sunlight in the OFF state with no electrical bias, and more particularly to cooling of a plurality of LEDs used for outdoor lighting under conditions of solar heating or electrical bias.

2. Description of Related Art

LEDs are light emitting solid state devices comprised of semi-conducting materials joined at a junction. Electrical current through such a solid state device will produce heat, and heat build up within LEDs will not only reduce their light output but will also cause a shift of electrical parametric characteristics. However, properly designed support circuits will anticipate or track and adjust or compensate for parametric changes within certain limits. The usable or functional life of an LED is inversely proportional to its life-long average junction temperature, and if temperature exceeds prescribed limits, permanent damage to the LED will certainly occur. It is therefore important to keep the LED as cool as possible for maximum life span and ultimately to prevent or forego failure.

Ambient air heat exchangers are among the most commonly used methods to cool a semiconductor, having multiple fins to enlarge the effective surface area for convection cooling. A plurality of high-output LEDs combined in arrays will experience mutual heating and can require about nine or more square inches of surface area per watt of electrical power dissipated in order to keep the LED junctions within the safe operating temperature range specified by the LED manufacturer. Therefore an array that requires forty watts (40 W) of electrical power can require almost four hundred square inches (400 $in^2$) of heat dissipating surface area to achieve adequate cooling in ordinary airflow. Actual LED measurements with the exemplary embodiment of the present invention with forty watts (40 W) applied have shown temperature rise for a four hundred square inch (400 $in^2$) heat exchange area to be twenty-nine degrees Celsius (29° C.), thus providing 0.75 degrees Celsius per watt (0.75° C./W) thermal resistance to the surrounding air.

Solar heating of space and liquids is a well known science today, and solar collectors constructed of known materials collect solar energy predictably based on the known relationships of collector surface area and coating or finish, collector material, BTU rate, watts and thermal resistance. The delivery rate of solar energy used in collector calculations is 320 BTU/hour per square foot area of flat surface solar collector perpendicular to the solar rays at sea level. One BTU per hour is equivalent to 0.29 watts of power.

A typical heat exchanger of the prior art adapted to an LED luminaire will have its entire upper surface area generally perpendicular to the sun's rays, while the majority or all of the underside area will be for LED light emission and not used for cooling. With the prior art concepts, certain conditions can occur where the LED temperature can exceed eighty-five degrees Celsius (85° C.), a level that most LED manufacturers list as a maximum storage temperature not to be exceeded.

In the exemplary embodiment, the present invention is used with a relatively high lumen output device specifically intended for outdoor illumination applications, and when powered, the associated LEDs rely on a large area heat exchange mechanism for adequate cooling. Consequently, the heat exchanger is exposed to direct sunlight during daylight hours when the LEDs are not powered on. It will be obvious to one skilled in the art that a primary objective of the present invention is to reduce solar heating of the LEDs even when in the OFF state, as accomplished in the present invention, at least in part, by lowering temperature as a result of the large convection cooling mechanism exposed in the outdoor solar environment. Surprisingly, the results of actual temperature measurements and comparisons of the present invention show a better than anticipated daytime cooling effect by adding convection fin area while not simultaneously adding to the solar collecting area.

In the prior art, U.S. Pat. No. 5,782,555 to Hochstein cites temperatures that reach eighty-five degrees Celsius (85° C.) in traffic signals and discloses an LED device that operates accordingly, yet with the caveat of shortened LED life. Additional prior art U.S. Pat. Nos. 6,450,662, 6,527,422 and 6,614,358 to Hutchison each disclose solar louvered external air cooled heat sinks, thereby shielding the cooling apparatus from solar energy. These prior art inventions are evidence of the benefits and efforts to shade heat exchangers from solar energy. However, these inventions are predominantly for small signaling and display LEDs under electrical bias for traffic signals. Outdoor illumination using LEDs is relatively new technology at the time of the present invention, requiring high-power, high-output LEDs with considerable size heat exchangers that would be yet even larger if applying techniques taught by the inventions of the prior art. The preferred embodiment of the present invention reduces the solar collecting effect of said heat exchangers, and does so as a single device without the need for an additional sun shade element.

Aspects of the present invention are then directed to one or more features including but not limited to: (1) providing a single extruded component with the necessary surface area to adequately cool the LED array when operating under full electrical bias; (2) incorporating additional cooling fins that are inherently shaded from solar energy by position alone, and therefore expel or radiate a portion of the solar energy collected from the total of all surfaces without themselves collecting additional solar energy; (3) providing an LED mounting surface that has some feature of ambient convection and that can be molded or extruded to aim outward or downward at an angle not fixed by the thermal design of the other convective surfaces; (4) having the combined solar-exposed and solar-shaded cooling fins join together for balancing or limiting the solar thermal rise with some thermal resistance to the LED mounting area; and (5) forming the shape entirely as an extruded or molded component without requiring additional components to shade the cooling fins. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention are generally directed to an LED cooler apparatus for an outdoor lighting unit exposed to direct sunlight during use comprising a mounting flange on which is mounted at least one LED, the mounting flange being at an acute angle relative to vertical when the LED cooler apparatus is installed on the outdoor lighting unit, and a support structure extending from the mounting flange and defining an upper convective surface substantially exposed to the direct sunlight and a lower convective surface substantially shaded by the support structure from the direct sunlight, whereby the acute angle of the mounting flange relative to the support structure allows for the shaded lower convective surface, and whereby the support structure has the thermal sum of solar heat from the upper convective surface less the convection cooling by both the upper and lower convective surfaces.

Further aspects of the present invention are generally directed to a support rib extending from the mounting flange, and at least one convective lower cooling fin extending substantially downwardly from the rib so as to be substantially shaded by the rib from direct sunlight, the rib and the at least one lower cooling fin comprising the support structure for the mounting flange.

Still further aspects of the present invention are generally directed to a dual-finned heat exchanger that has cooling fins located unavoidably in an area exposed to solar energy and also has cooling fins located specifically in a shaded area beneath the main structure away from solar exposure in a manner to increase convective surface area without adding solar surface area.

Yet further aspects of the present invention are generally directed to at least two upper cooling fins extending substantially upwardly from the support rib, the at least two upper cooling fins being substantially exposed to direct sunlight and so comprising the upper convective surface.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
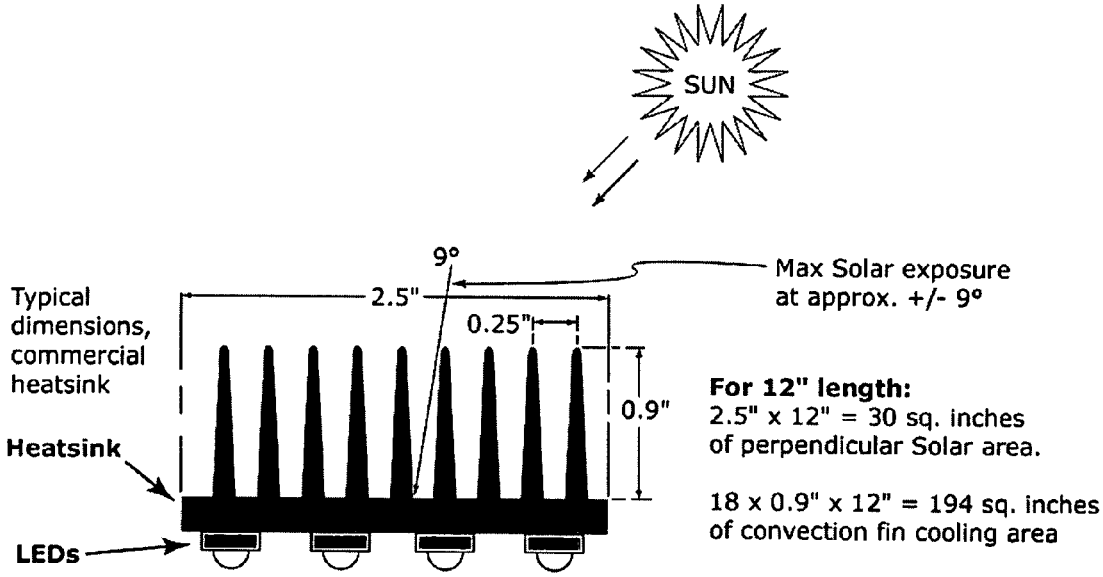
Prior Art Fig. 1
FIG. 1 is a side schematic view of a en exemplary prior art heat sink with mounted LEDs.

Turning first to FIG. 1, there is shown an illustration of an exemplary heat sink typical of the prior art with details of a finned cooling area located above the LED mounting surface. FIG. 1 shows an exemplary perpendicular solar area as two and a half inches by twelve inches, or thirty square inches (2.5 in.×12 in.=30 in$^2$), and the convective fin area as one hundred ninety-four square inches (194 in$^2$). Also shown is one nine degree (9°) ray to illustrate the maximum angle of a fin irradiated by solar energy in this exemplary prior art heat sink.

Figure 2:
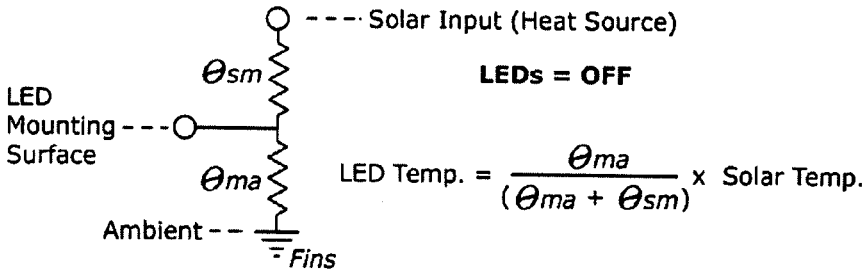
Prior Art Fig. 2
FIG. 2 is a thermal circuit diagram of the prior art heat sink of FIG. 1.

Referring to FIG. 2, there is shown a schematic diagram for the thermal circuit of the typical prior art heat sink as in FIG. 1. Here it is shown that solar heat is conducted through θsm of which thermal resistance is a function of the surface coating that is typically black anodizing for maximum thermal radiation during the LED ON period. FIG. 2 shows that the incoming solar thermal energy connects to the LED mounting through a single attenuator, and it further shows the cooling fin to be a single thermal resistance θma to the ambient air (° C./W mounting to ambient) as follows:

$$\text{LED Temperature Rise}=(\theta ma\div(\theta ma+\theta sm))\times\text{Solar Collector Temp.}$$

Figure 3:
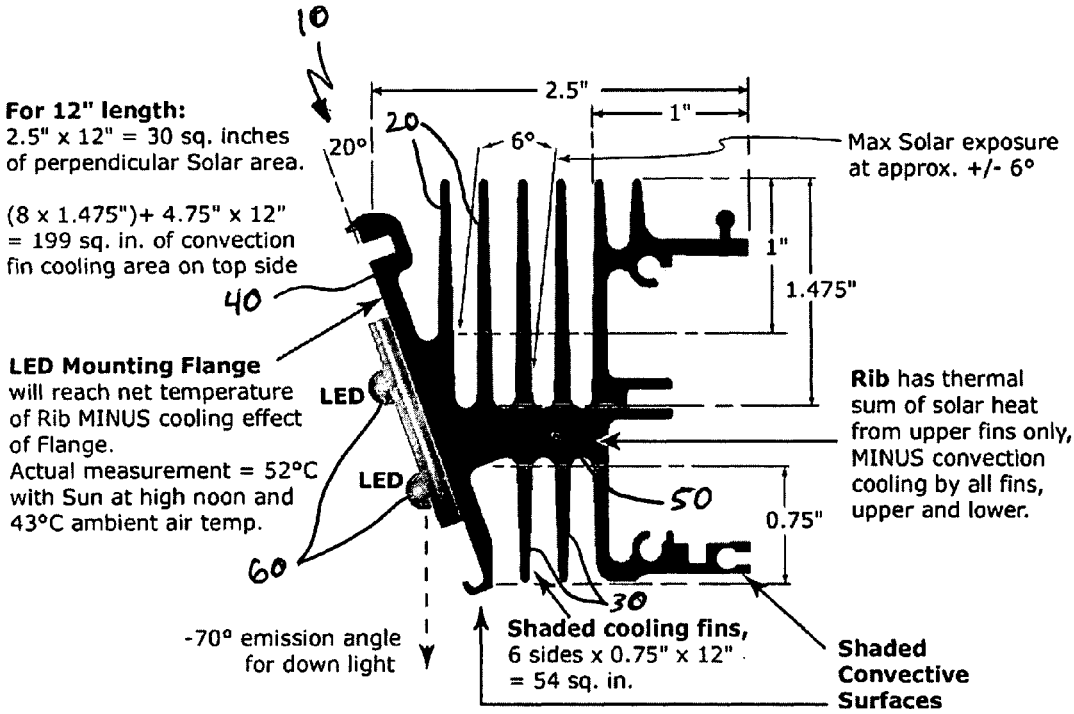
FIG. 3 is a side schematic view of an exemplary LED cooler apparatus of the present invention.

Turning now to FIG. 3, there is shown an exemplary embodiment LED cooler 10 of the present invention with details of the upper cooling fins 20 and lower cooling fins 30 along with the LED mounting flange 40. FIG. 3 shows in the exemplary embodiment an upper perpendicular solar area as two and a half inches by twelve inches, or thirty square inches (2.5 in.×12 in.=30 in$^2$), with the convective area of the upper fins 20 and other surfaces, together defined as the upper convective surface, being one hundred ninety-nine square inches (199 in$^2$). It is further shown that the LED mounting flange 40 is located a thermal distance away from the fin area. For illustration, FIG. 3 shows six-degree (6°) rays to illustrate the maximum angle of the fins irradiated by solar energy based on the length and spacing of the fins in the exemplary embodiment. It will be appreciated by those skilled in the art that the number, lengths, and spacing of the fins, and the resulting solar and convective surface areas, is merely exemplary and that the invention is not so limited. Rather, depending on the lighting application and the requirements in terms of the number and orientation of the LED sources 60, the number and geometry of such fins 20 can vary greatly without departing from the spirit and scope of the present invention. With continued reference to FIG. 3, also shown are fifty four square inches (54 in$^2$) of convective lower fins 30 and other surfaces, together defining the lower convective surface, located in the solar shade on the underside of the LED cooler 10 beneath the rib 50. The rib 50 is shown as being somewhat central to all other attachments, namely the upper fins 20, the lower fins 30, and the mounting flange 50, and so serves as a thermal passage therebetween as well as providing a structure to which all other structures of the LED cooler apparatus 10 can be mounted. Once again, it will be appreciated that the number, lengths, and spacing of the lower fins 30, and the resulting lower convective surface area, is merely for illustration and that numerous other configurations of the lower fins 30 may be employed in the present invention without departing from its spirit and scope. Furthermore, those skilled in the art will appreciate that the rib 50 may be formed in a variety of configurations depending on the context, including its size and orientation relative to the fins and mounting flange. The upper and lower cooling fins 20, 30 and the rib 50 together generally define the support structure for the mounting flange 40. In the exemplary embodiment, the LED mounting flange 40 being offset in angle and distanced away from the central connecting rib 50 takes advantage of LED wide-angle optical emission that provides light directly beneath the LED cooler apparatus 10 by utilizing LEDs 60 having seventy-degree (70°) and higher beam angles. Additionally, an advantage of not having the LEDs 60 emitting directly downward as in the present invention is that most underside surfaces become shaded convective surfaces, a feature not possible or practical when LEDs occupy the underside. As with the fin geometries, it will be appreciated by those skilled in the art that although an acute angle of twenty degrees (20°) is shown for the LED mounting flange 40 relative to vertical, or seventy degrees (70°) to the substantially horizontal rib 50, a variety of angles can be well matched to the optical, mechanical and thermal packaging criteria, such that the particular angles shown in the exemplary embodiment of FIG. 3 should in no way be construed to limit the scope of the present invention.

Figure 4:
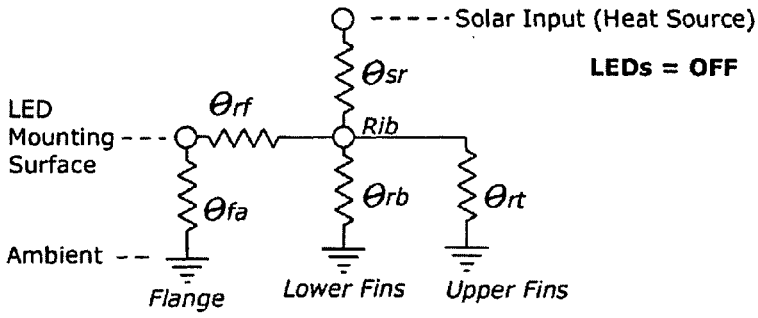
FIG. 4 is a thermal circuit diagram of the exemplary LED cooler apparatus of FIG. 3.

FIG. 4 is a schematic diagram for the thermal circuit of the exemplary embodiment LED cooler apparatus 10 as shown in FIG. 3 and described above. The nomenclature employed is as follows: θsr=° C./W solar to rib; θrt=° C./W rib to upper fins; θrb=° C./W rib to lower fins; θfa=° C./W flange to ambient; and θrf=° C./W rib to flange. Here it is shown that solar heat is conducted into θsr of which thermal resistance is a function of the surface coating and once more is typically black anodizing for maximum thermal radiation during the LED ON period. The incoming solar thermal resistance θsr connects to the rib, and it is shown that solar heat is then radiated through resistances θrt and θrb that represent the upper and lower fins, respectively, such that the thermal energy is attenuated twice in the path to the LED flange, with the thermal equation thus shown as:

$$\text{LED Temp. Rise} = \left(\theta fa \div (\theta fa + \theta rf)\right) \times \frac{(1/(1/\theta rb + 1/\theta rt))}{(1/(1/\theta rb + 1/\theta rt) + \theta sr} \times \text{Solar Coll. Temp.}$$

Those skilled in the art will readily see the thermal advantages of the present invention during both the LED powered mode and the un-powered mode when solar energy collection is reduced and further attenuated in the path toward the LED mounting flange.

In the comparative examples presented herein of prior art heat sinks and an exemplary embodiment of the LED cooler of the present invention, with each oriented in a typical position, the apparent solar area that can be perpendicular to the sun is approximately two and a half inches by twelve inches, or thirty square inches (2.5 in.×12 in.=30 in$^2$). Thirty square inches of solar collector can provide a maximum power of:

$30 \div 144 = 0.21\ \text{ft}^2$ $0.21 \times 320 = 67$ BTU/hr $67 \times 0.29 = 19.5$ watts Given the previously shown thermal resistance to air of 0.75° C./W as measured, the maximum heat rise is calculated as:

$0.75°\ \text{C.}/W \times 19.5\ \text{watts} = 15°\ \text{C.}$

Maximum solar energy is received in a flat solar collector when the sun's rays are perpendicular; however, it should be noted that a large square area of finned heat exchangers can be irradiated by solar energy for a time at certain angles of the sun that are not perpendicular. The cosine effect reduces the energy of solar rays that are not normal to the collector surface angle, though with a finned heat exchanger, solar energy that will partially reflect from a first surface or fin will be absorbed by a plurality of additional surfaces or fins, with inter-reflected solar rays adding to the estimated collected power. For example, one and a half inch (1.5 in.) tall cooling fins spaced one quarter inch (0.25 in.) apart can allow the sun's rays at noon plus or minus six degrees (6°) to directly irradiate all of one side or one-half of every cooling fin, for which a twelve inch (12 in.) long device having six fins exceeds one hundred square inches (100 in$^2$) of solar irradiated area, in addition to the same solar rays reflecting from at least two more surfaces.

For example, on a hot summer day wherein ambient temperature reaches thirty-five degrees Celsius (35° C.), or roughly ninety-five degrees Fahrenheit (95° F.), the eighty-five degrees Celsius (85° C.) maximum LED temperature would be reached when the heat exchanger has a fifty degrees Celsius (50° C.) rise. As stated previously, a heat exchanger of nearly four hundred convective square inches (400 in$^2$) has been shown to provide adequate thermal management when typical outdoor LEDs are powered. With the conventional heat sink design of the prior art placing all four hundred square inches (400 in$^2$) in a solar path and collecting only solar energy without LED power, about half, or two hundred square inches (200 in$^2$) of solar collection can be used for the purpose of estimating temperature rise. Given the preceding calculations, this solar collection can exceed 320 BTU/hr, and reducing estimates by yet another half for cosine effect and other losses yields:

$200 \div 144 = 1.4\ \text{ft}^2$ $1.4 \times 320 = 448$ BTU/hr $448 \times 0.5 = 224$ (cosine effect and other loss factors, etc.)

$224 \times 0.29 = 65$ watts $65\ \text{watts} \times 0.75°\ \text{C.}/W = 49°\ \text{C.}$ The previous examples of calculations, with particular application and with actual solar trials and thermal measurements, show the advantage of the present invention by having, in the exemplary embodiment, over thirty percent (30%) of the LED cooler's convective cooling area located on the shaded lower side of the extrusion. Measurement of the exemplary embodiment heat exchanger in direct sunlight with an ambient temperature of forty-three degrees Celsius (43° C.), or one hundred and nine degrees Fahrenheit (109° F.) found the LED mounting flange to be only fifty-two degrees Celsius (52° C.), a rise of only nine degrees Celsius (9° C.) that is considerably lower temperature than anticipated by calculation. Measurements of an equivalent perpendicular-square-inch prior art version without solar-shaded convective area found the LED mounting surface at sixty degrees Celsius (60° C.) in the same ambient temperature of forty-three degrees Celsius (43° C.), thus a seventeen degrees Celsius (17° C.) rise in temperature. Therefore, the thermal solution of the present invention has been shown to be relatively more effective in neutralizing solar heating with ambient air than typical prior art heat exchangers and than even first anticipated, with the end results having been illustrated by actual temperature measurement.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. An LED cooler apparatus for an outdoor lighting unit exposed to direct sunlight during use, the apparatus comprising:

a mounting flange on which is mounted at least one LED;

a support rib extending from the mounting flange;

at least one convective lower cooling fin extending substantially downwardly from the rib so as to be substantially shaded by the rib from the direct sunlight; and at least two upper cooling fins extending substantially upwardly from the rib opposite the at least one lower cooling fin, whereby the rib has the thermal sum of solar heat from the at least two upper cooling fins less the convection cooling by both the at least two upper fins and the at least one lower fin.

2. The apparatus of claim 1 wherein:

the support rib is substantially horizontal when the LED cooler apparatus is installed on the outdoor lighting unit; and the mounting flange is installed relative to the support rib at an acute angle.

3. The apparatus of claim 2 wherein the acute angle is between forty-five and ninety degrees.

4. The apparatus of claim 3 wherein the acute angle is seventy degrees.

5. The apparatus of claim 1 wherein the at least one LED is a wide-angle optical emission LED.

6. The apparatus of claim 5 wherein the at least one LED has an emission angle for down light of between forty-five and ninety degrees.

7. The apparatus of claim 6 wherein the emission angle is at least seventy degrees.

8. The apparatus of claim 1 wherein:

the mounting flange is at an angle relative to vertical of between zero and forty-five degrees when the LED cooler apparatus is installed on the outdoor lighting unit; and the at least one LED is a wide-angle optical emission LED having an emission angle for down light of between forty-five and ninety degrees.

9. An LED cooler apparatus for an outdoor lighting unit exposed to direct sunlight during use, the apparatus comprising:

a mounting flange on which is mounted at least one wide-angle optical emission LED having an emission angle for down light of between forty-five and ninety degrees, the mounting flange being at an angle relative to vertical of between zero and forty-five degrees when the LED cooler apparatus is installed on the outdoor lighting unit;

a support rib extending from the mounting flange;

at least two upper cooling fins extending substantially upwardly from the rib; and at least one lower cooling fin extending substantially downwardly from the rib offset from the mounting flange so as to be substantially shaded by the rib from the direct sunlight, whereby the acute angle of the mounting flange relative to the rib allows for a shaded convective surface area beneath the rib as defined at least in part by the at least one lower cooling fin, and whereby the rib has the thermal sum of solar heat from the at least two upper cooling fins less the convection cooling by both the at least two upper fins and the at least one lower fin.

10. An LED cooler apparatus for an outdoor lighting unit exposed to direct sunlight during use, the apparatus comprising:

a mounting flange on which is mounted at least one LED, the mounting flange being at an acute angle relative to vertical when the LED cooler apparatus is installed on the outdoor lighting unit; and a support structure extending from the mounting flange, the support structure defining an upper convective surface substantially exposed to the direct sunlight and having an upper convective surface area, and a lower convective surface substantially shaded by the support structure from the direct sunlight and having a lower convective surface area, whereby the acute angle of the mounting flange relative to the support structure allows for the shaded lower convective surface, and whereby the support structure has the thermal sum of solar heat from the upper convective surface less the convection cooling by both the upper and lower convective surfaces.

11. The apparatus of claim 10, wherein the lower convective surface area is at least twenty-five percent of the upper convective surface area.

12. The apparatus of claim 11, wherein the support structure comprises:

a rib extending from the mounting flange;

at least two upper cooling fins extending substantially upwardly from the rib and comprising the upper convective surface; and at least one lower cooling fin extending substantially downwardly from the rib and comprising the lower convective surface.

13. The apparatus of claim 10, wherein:

the mounting flange is at an angle of roughly twenty degrees relative to vertical; and the at least one LED is a wide-angle optical emission LED having an emission angle for down light of at least seventy degrees.

14. A method of using an LED cooler apparatus to convection cool an outdoor lighting unit exposed to direct sunlight during use, the method comprising the steps of:

installing at least one LED on a mounting flange;

mounting the mounting flange on a support structure so as to form the LED cooler apparatus; and positioning the LED cooler apparatus on the outdoor lighting unit such that the mounting flange is at an acute angle relative to vertical, whereby an upper convective surface is formed above the support structure so as to be substantially exposed to the direct sunlight and a lower convective surface is formed beneath the support structure so as to be substantially shaded from the direct sunlight, and whereby the support structure has the thermal sum of solar heat from the upper convective surface less the convection cooling by both the upper and lower convective surfaces.

* * * * *